United States Patent [19]

Fukai et al.

[11] 3,985,918

[45] Oct. 12, 1976

[54] METHOD FOR MANUFACTURING A TARGET FOR AN IMAGE PICKUP TUBE

[75] Inventors: Masakazu Fukai, Nishinomiya; Shinji Fujiwara, Toyonaka; Hiroyuki Serizawa, Katano; Osamaru Eguchi, Higashi-Osaka; Yukimasa Kuramoto, Takarazuka, all of Japan

[73] Assignee: Matsushita Electric Industrial Co., Ltd., Osaka, Japan

[22] Filed: Jan. 23, 1975

[21] Appl. No.: 543,550

Related U.S. Application Data

[63] Continuation-in-part of Ser. No. 405,172, Oct. 10, 1973, abandoned.

[30] Foreign Application Priority Data

| | | |
|---|---|---|
| Oct. 12, 1972 | Japan | 47-102516 |
| Dec. 5, 1972 | Japan | 47-122722 |
| Dec. 5, 1972 | Japan | 47-122723 |
| Dec. 5, 1972 | Japan | 47-122724 |
| Dec. 5, 1972 | Japan | 47-122725 |

[52] U.S. Cl. ..... 427/76; 313/94; 313/366; 313/386; 357/11; 357/16; 427/74; 427/87; 427/109; 427/126; 427/248 J; 427/255; 427/350; 427/372 R; 427/377; 427/380; 427/419 F

[51] Int. Cl.[2] ..... B05D 5/12; B05D 3/02

[58] Field of Search ..... 357/11, 16, 386; 313/94, 366; 427/74, 76, 87, 109, 126, 248, 255, 350, 372, 377, 380, 419

[56] References Cited

UNITED STATES PATENTS

| | | | |
|---|---|---|---|
| 3,405,298 | 10/1968 | Dresner | 357/11 |
| 3,571,646 | 3/1971 | Kiuchi | 313/94 |
| 3,755,002 | 8/1973 | Hirai | 357/16 |
| 3,858,074 | 12/1974 | Fukai | 313/94 |

FOREIGN PATENTS OR APPLICATIONS

| | | |
|---|---|---|
| 7,215,094 | 5/1973 | Netherlands |

*Primary Examiner*—Ronald H. Smith
*Assistant Examiner*—W. H. Schmidt
*Attorney, Agent, or Firm*—Stevens, Davis, Miller & Mosher

[57] ABSTRACT

A target for an image pickup tube having high sensitivity, low dark current and low amount of lag-image is manufactured by forming a hetero-junction by the evaporation process. A first layer of $ZnS_xSe_{1-x}$ or $Zn_uCd_{1-u}S$ (wherein $0 \leqq x \leqq 1$ and $0 \leqq u \leqq 1$) is deposited on a light transmitting substrate having a coefficient of linear expansion of $56 \times 10^{-7}/°C$ $-110 \times 10^{-7}/°C$ and a second layer of $(Zn_yCd_{1-y}Te)_z(In_2Te_3)_{1-z}$ (wherein $0.1 \leqq y \leqq 0.9$ and $0.7 \leqq z \leqq 1$) is deposited on the first layer. The substrate is then heat treated in an inert gas atmosphere or under vacuum at a temperature of 350°–650°C, preferably 500°–600°C for a time period of 5–90 minutes, preferably 5–15 minutes. By effecting second heat treatment at a temperature lower than the first heat treatment temperature, preferably at a temperature of 150°–400°C for 20 minutes – 3 hours, the characteristics of the target are further improved.

6 Claims, 5 Drawing Figures

ILLUMINANCE CHARACTERISTICS $ZnSe-(Zn_{0.7}Cd_{0.3}Te)_{0.95}(In_2Te_3)_{0.05}$

I FLASH VACUUM EVAPORATION METHOD (TARGET VOLTAGE 15V)

II ONE-SOURCE VACUUM EVAPORATION METHOD (TARGET VOLTAGE 20V)

III TWO-SOURCE VACUUM EVAPORATION METHOD (TARGET VOLTAGE 20V)

METHOD FOR MANUFACTURING A TARGET FOR AN IMAGE PICKUP TUBE

CROSS REFERENCE TO RELATED APPLICATIONS

This is a continuation-in-part of co-pending application Ser. No. 405,172 filed on Oct. 10, 1973 and now abandoned.

BRIEF SUMMARY OF THE INVENTION

The present invention relates to a method for manufacturing a target for an image pickup tube which utilizes a hetero-junction of $ZnS_xSe_{1-x}$ (wherein $0 \leqq x \leqq 1$) and $(Zn_yCd_{1-y}Te)_z(In_2Te_3)_{1-z}$, (wherein $0.1 \leqq y \leqq 0.9$ and $0.7 \leqq z \leqq 1$) or a hetero-junction of $Zn_uCd_{1-u}S$ (wherein $0 \leqq u \leqq 1$) and $(Zn_yCd_{1-y}Te)_z(In_2Te_3)_{1-z}$ (wherein $0.1 \leqq y \leqq 0.9$ and $0.7 \leqq z \leqq 1$). These hetero-junctions may be formed by an evaporation process. The characteristics of the target for the image pickup tube are considerably affected by the coefficient of linear expansion of a light transmitting substrate, temperature of the substrate, temperature of an evaporation source, time duration of thermal treatment after evaporation, its temperature and its atmosphere. When a target manufactured under conditions which are optimized to give desired properties thereto is attached to an image pickup tube, such a tube exhibits a high sensitivity over substantially the entire visible light band, low dark current and low amount of lagimage.

A vidicon type image pickup tube is of simple construction and easy to manufacture. Major performance thereof depends upon its target characteristics. Thus the improvement of the image pickup tube has been made mainly by employing photo-conductive materials having better characteristics. Nowadays, those which had been previously used only in an industrial field have been used not only in the broadcasting field but also in other fields. As the application fields have thus spread, the need for improved performance has increased more and more. As yet $Sb_2S_3$, PbO, Si etc. have been practically used as photoconductive material and CdSe is also in the region of practical use. From the structural aspect, they are classified into those formed with an amorphous layer on a vitreous layer such as an $Sb_2S_3$ target, those of multi-layer structure such as a PbO target and a CdSe target and those of an arranged p-n junction such as an Si target. When these categories of targets are used in the image pickup tubes, the following advantages and disadvantages are observed:

a. $Sb_2S_3$ vidicon

It has a photo-electric sensitivity of 200–300 $\mu$A/lm and a dark current of 20 nA for a 1 inch vidicon, so that it can pick up only those images having a brightness less than about 5 luxes. Otherwise an after-image will be produced. It exhibits a considerable amount of lag-image and residual image. The manufacturing process is rather simple.

b. PbO vidicon

It has a photo-electric sensitivity of 300 $\mu$A/lm and a dark current of 0.2 nA for a one and a half inch PbO vidicon. It exhibits a very low amount of lag-image. On the other hand, the spectral sensitivity band thereof is narrow and the sensitivity for red color is insufficient.

c. Si vidicon

It has a photo-electric sensitivity about 20 times higher than that of the $Sb_2S_3$ vidicon and shows no after-image. On the other hand, since a Si single crystal is used it is susceptible to being damaged and the resolution power thereof is limited due to the arranged p-n junction structure.

d. CdSe vidicon

It has a photo-electric sensitivity of 3300 $\mu$A/lm and a dark current of 1 nA for a 1 inch CdSe vidicon and hence it may be considered to be a fairly high performance image pickup tube. The lag-image characteristic thereof is, however, somewhat poor.

Accordingly, it is an object of the present invention to provide a method for manufacturing reproducibly a target for an image pickup tube which has a high sensitivity over substantially the entire visible light band, a low dark current, a low amount of lag-image and which is not easily damaged.

It is another object of the present invention to provide a method for manufacturing the target for an image pickup tube which method is easy to practice.

Bearing in mind the charactertistics and the problems of the prior art image pickup tubes as discussed hereinabove, the inventors of the present invention endeavored to develop an image pickup tube target of improved characteristics and eventually developed a target having a hetero-junction structure. It consists of material of the II–IV group elements. It may be formed by the vacuum evaporation technique but a special technique is required where a product of higher performance is to be manufactured. It is generally considered that not only the compounds consisting of elements having a substantial differential vapor pressure but also multi-element systems can not provide targets of high performance because the evaporated films thereof, when evaporated in a conventional vacuum evaporation process, show a considerable amount of nonuniformity in composition in the direction of their thickness. In order to prevent such nonuniformity it has been proposed to use a flash evaporation process. However, since this process employs powder and necessitates a high temperature for instantaneous evaporation, a rapid increase of the damage of the product is observed. In addition, with this process it is difficult to control evaporation rate and film thickness, resulting in nonuniformity in the characteristics of the film and hence a low degree of reproducibility; that is, the properties of the inside of the film deposited on the substrate are not uniform. It has also been proposed to divide the evaporation source into two or three subsources and divide materials to be evaporated into each of the elements or into a certain number of compounds and separately control the respective evaporation source temperatures to effect simultaneous evaporation while preventing the occurrence of the nonuniformity in the composition. This approach, however, requires complex apparatus and it is difficult to establish proper evaporation conditions. After an extensive investigation, the inventors have succeeded in manufacturing, by the simplest evaporation method with a single evaporation source, a target that has good reproducibility, excellent characteristics and is free of damage. In the course of the experiments, it has been found that the coefficient of linear expansion of a light transmitting substrate forming the target for the image pickup tube has an influence particularly on the dark current and the damage. It has been made clear from the detailed analysis of various light transmitting substrates having different coefficient of linear expansion that the coefficient of linear expansion should be chosen within a certain range. Furthermore, the evaporation conditions in the single source evaporation process such as substrate temperature and evaporation source temperature have been studied, and again it has been made clear that those temperature should be chosen within certain ranges. It has been further found that in order to provide a product of higher performance, it is desirable to prepare a substrate of having a hetero-junction structure and subsequently heat treat the same within a certain temperature range for a certain range of time period in an inert gas atmosphere or under vacuum. The resulting product may further be subjected to heat treatment again at a temperature lower than that used in the first heat treatment in order to further improve its characteristics.

BRIEF DESCRIPTION OF THE DRAWINGS

The above and other objects, features and advantages of the present invention will be made apparent by the detailed description taken in conjunction with the accompanying drawings, in which.

DETAILED DESCRIPTION

Before discussing the method of manufacturing the target for the image pickup tube in accordance with the present invention, it will be advisable to explain the methods of measuring the characteristics of a hetero-junction element and those of the image pickup tubes.

A. METHOD OF MEASURING CHARACTERISTIC OF ELEMENT

In measuring the characteristics of the hetero-junction element, electrodes were formed by silver paste on the transparent conductive film and the second film layer to form a sandwich type cell. The dark current, photo-electric current, light response speed and spectrum sensitivity characteristic of the cell were measured by the apparatus shown in FIG. 1.

a. Spectrum sensitivity characteristic

An interference filter having a half power width of 10–20 mμ and a halogen lamp having a color sensitivity of 3400° K were used to measure the photoelectric current at 20 mμ interval. The amount of light impinging on a specimen from the light source through the filter was measured by a thermopile. The vertical axis of the spectrum sensitivity characteristic curve is scaled in equi-energy sensitivity.

b. Dark current and photoelectric current

An electrometer manufactured by Keithley Co. (Model 610C) was used to measure the current-voltage characteristic and the photoelectric current-illumination characteristic.

c. Light response characteristic

Figure 1:
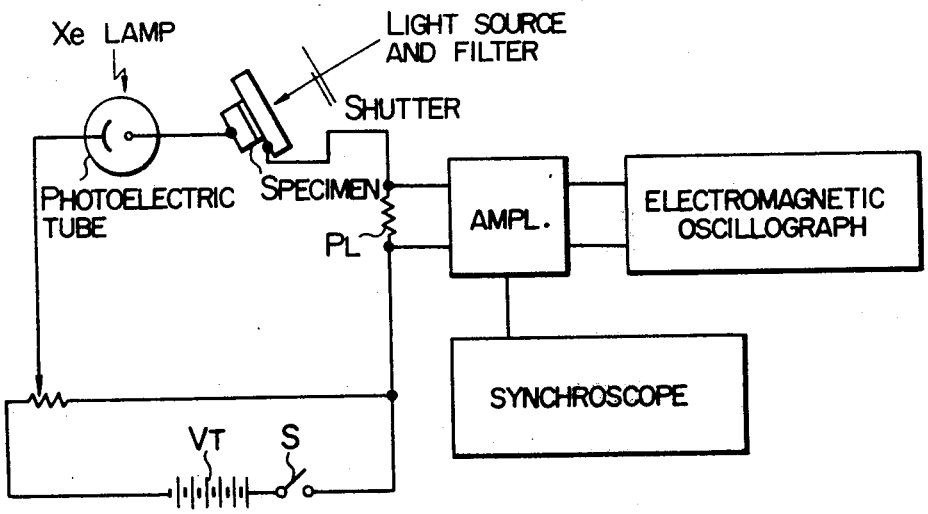
FIG. 1 is a schematic diagram of apparatus for measuring light response characteristics with a sandwich type cell wherein $P_L$ represents a load resistor, $V_T$ represents a D.C. voltage source and S represents a switch.

The inventors of the present invention have constructed a circuit (which does not use an electron beam) that is equivalent to one picture element of the image pickup tube scanned by an electron beam and have measured the characteristic of the image pickup tube by the element. FIG. 1 illustrates the principle of the measurement method. It is characterized by a photoelectric tube being turned on and off by a light pulser of 2 μ sec pulse duration at a frequency of 60 Hz so as to correspond to an electron beam acting on one picture element at 60 Hz in the image picture tube. The element was illuminated with light of 0.4 lux from a separate light source (halogen lamp of 3400° K) and the light response was measured by a photographic shutter. The comparison of the results measured by this method with the results measured after the assembly of the image pickup tube showed a fairly good correspondence. The measurements show the magnitude of signals in percentage 50 m sec after switching off the light source.

d. Composition of deposited film

The composition of the deposited film was analyzed by a solid mass analysis method and a radioactive analysis method.

B. METHOD OF MEASURING CHARACTERISTICS OF IMAGE PICKUP TUBE a. Dark current and photoelectric current The measurement was effected by applying a positive voltage on the side of the transparent conductive film layer while scanning with an electron beam and taking out signal current therefrom.

b. Lag-image, after-image and residual image

The lag-image is a transient characteristic of the image pickup tube and represents the magnitude of the signal current remaining 50 m sec after switching the light.

Definition: The lag-image is defined as a transient phenomenon occurring when the light condition is switched from light to dark conditions. It is generally represented by the magnitude of the signal in percentage which remains 50 m sec after switching off the light.

The residual image is the image still remaining after the light source is turned off and is defined by the length of time required for the signal current to become zero.

The after-image is measured by the time period required for the remaining image to extinguish, as observed by a video monitor, when the image has been picked up for a specified time period under a standard image pickup condition and subsequently a uniformly white background is picked up.

Having described the methods of measuring the characteristics of the element and the image pickup tube, the method of manufacturing the target of the image pickup tube in accordance with the present invention will now be described.

Figure 2:
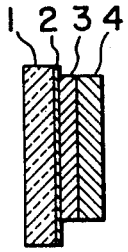
FIG. 2 shows a sectional view of a target for an image pickup tube manufactured in accordance with the present invention wherein reference numeral 1 represents a light transmitting substrate, 2 represents a transparent conductive film, 3 represents a first film layer of $ZnS_xSe_{1-x}$ or $Zn_uCd_{1-u}S$ and 4 represents a second film layer of $(Zn_vCd_{1-v}Te)_z$ $(In_2Te_3)_{1-z}$.

As shown in FIG. 2, the target of the image pickup tube is constructed by forming the transparent conductive film 2 of, for example, $In_2O_3$ or $SnO_2$ on the light transmitting substrate 1 and forming the first layer 3 consisting of $ZnS_xSe_{1-x}$ or $Zn_uCd_{1-u}S$ with a thickness of 0.05–0.1 $\mu$ and then the second layer 4 consisting of $(Zn_yCd_{1-y}Te)_z$ $(In_2Te_3)_{1-z}$ with a thickness of 2–10 $\mu$. As an example, the light transmitting substrate had a coefficient of linear expansion of $72 \times 10^{-7}$/° C, and the first layer consisting of ZnSe (i.e. $x = 0$) was formed into a film of 0.1 $\mu$ thickness at a substrate temperature of 200° C and at an evaporation temperature of 900° C. The second layers were manufactured by the following three methods: the flash evaporation method wherein a powdered specimen is dropped onto a heater at an elevated temperature and evaporated instantaneously onto a heated substrate to be deposited thereon; the single source evaporation method wherein a single evaporation source is included, which is heated to evaporate a specimen onto a heated substrate; and the dual source vacuum evaporation method wherein two evaporation sources are included, which are heated to evaporate a specimen onto a heated substrate. The characteristics of the respective products were compared. The composition of the evaporation source for the second layer was chosen to be $y = 0.7$ and $z = 0.95$. With this composition, in the case of the flash evaporation process, it was fired at 1000° C for 2 hours and then treated to produce particles of uniform grain size. In the case of the single source evaporation process, the fired composition was used as it was without further treatment. In the case of the dual source evaporation process, it was divided into the fired product of $(ZnTe)_{0.95}$ $(In_2Te_3)_{0.05}$ and a polycrystal of CdTe. The following Table I shows the evaporation conditions for the second layer.

Table I

| Evaporation methods / Conditions | Flash evaporation | Single source Evaporation | Dual Source Evaporation | |
|---|---|---|---|---|
| | | | $ZnTe-In_2Te_3$ | CdTe |
| Charge Amount (g) | 2.0 | 1.0 | 1.0 | 1.0 |
| Evaporation Temperature(°C) | 1450 | 800 | 800 | 740 |
| Substrate Temperature (°C) | 150 | 150 | 150 | |
| Vacuum Condition (mmHg) | $1\times10^{-5}$ | $1\times10^{-5}$ | $1\times10^{-5}$ | |
| Film Thickness ($\mu$) | 5.0 | 5.0 | 5.0 | |

The evaporation time periods for the respective processes were controlled so that a constant thickness of 5 $\mu$ was obtained in each process. After the evaporation, the substrate was heat treated at 550° C for 10 minutes under vacuum. It has been observed from analysis of the films that the total compositions in the respective films were substantially identical although nonuniformity of the film composition in the direction of the thickness was not clear. The following Table II shows the characteristics of the element. The spectrum sensitivity characteristic is illustrated in FIG. 3 and the illumination characteristic is illustrated in FIG. 4.

Table II

Figure 3:
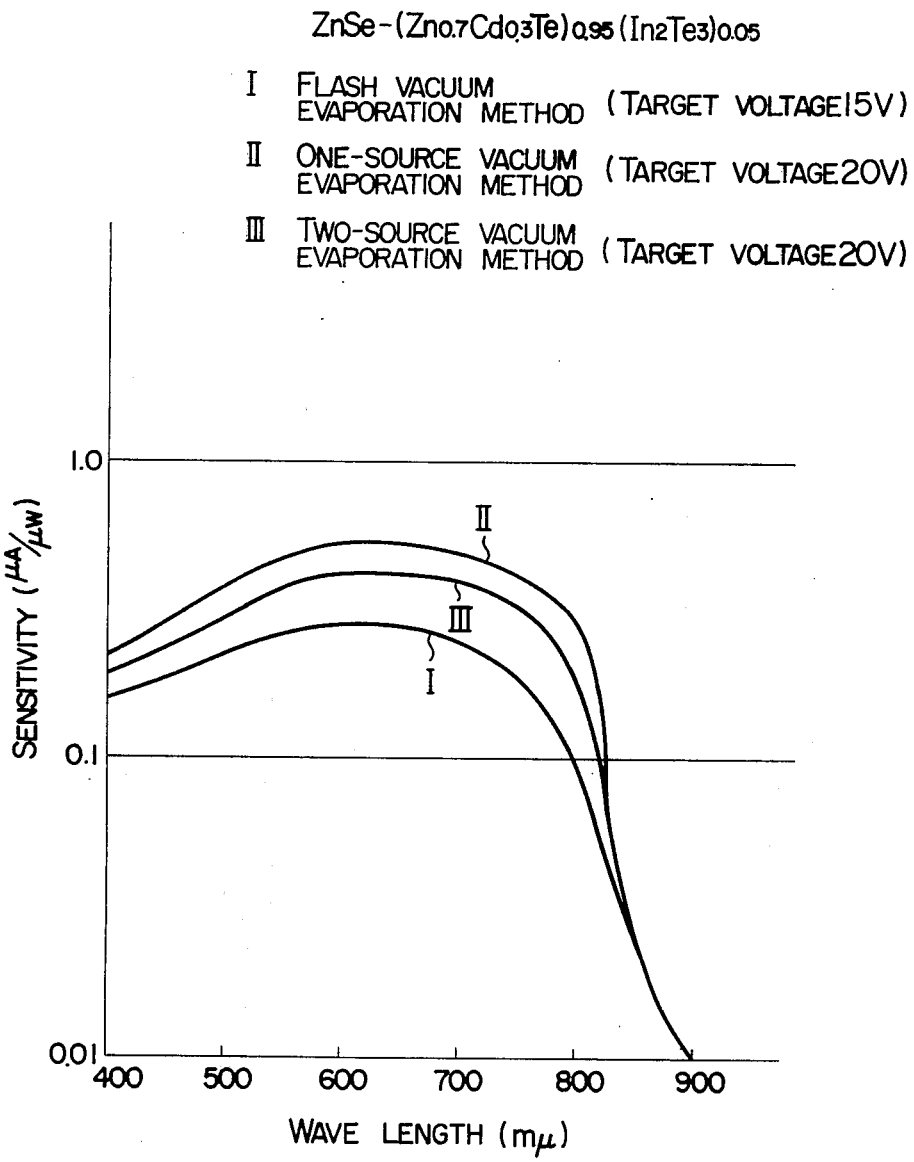
FIG. 3 shows spectral sensitivity curves I, II and III for the hetero-junctions of ZnSe and $(Zn_{0.7}Cd_{0.3}Te)_{0.95}$ $(In_2Te_3)_{0.05}$ which are respectively manufactured by a flash evaporation process, a single source evaporation process and a dual source evaporation process.
Figure 4:
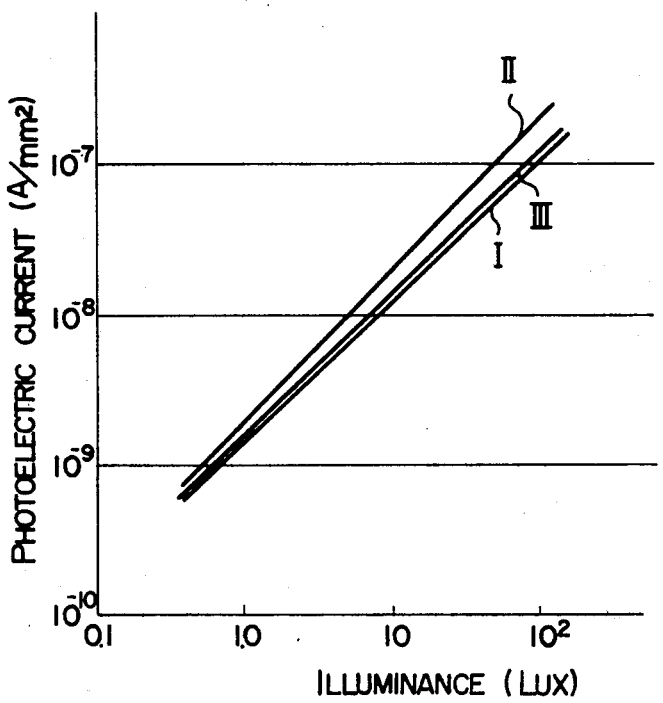
FIG. 4 illustrates illumination characteristics wherein curves I, II and III represent respectively the characteristic of the product manufactured by the flash evaporation process, the single source evaporation process and the dual source evaporation process.

| Evaporation methods / Characteristics | Flash Evaporation | Single Source Evaporation | Dual Source Evaporation |
|---|---|---|---|
| Applied Voltage (V) | 15 | 20 | 20 |
| Spectrum Sensitivity ($\mu$A/$\mu$W) | Fig. 3, Curve I | Fig. 3, Curve II | Fig. 3, Curve III |
| Dark Current (A/mm²) | $10\times10^{-11}$ | $3\times10^{-11}$ | $10\times10^{-11}$ |
| Lag-Image (%) | 15 | 10 | 14 |
| Illumination Characteristic | Fig. 4, Curve I $\gamma = 0.95$ | Fig. 4, Curve II $\gamma = 1.0$ | Fig. 4, Curve III $\gamma = 0.95$ |

It is seen from observation of Table II and FIGS. 3 and 4 that the target of the image pickup tube manufactured by the single source vacuum evaporation process to which the present invention is directed showed the most desirable characteristics. It is considered that a film manufactured by this process may exhibit nonuniformity in composition in the direction of film thickness as has been commonly recognized but the contribution of such nonuniformity to the characteristics is not clear. The inventors tried to control the evaporation temperatures of the respective evaporation sources in the dual source evaporation process in order to produce a film which approximates that produced by the single source evaporation process, but it has been found that the establishment of the condition was difficult and reproducibility was poor.

The inventors further studied the effect of evaporation conditions by changing the compositions of the first and second layers respectively. When the composition of the first layer was chosen to be $0 \leqq x \leqq 1$ and $0 \leqq u \leqq 1$, significant changes in the characteristics of the image pickup tube target were not observed regardless of the difference of evaporation conditions. When the composition of the second layer was chosen to be $0.1 \leqq y \leqq 0.9$ and $0.7 \leqq z \leqq 1$, considerable changes in the dark current and lag-image characteristics were observed due to the difference of evaporation conditions. In the dual source evaporation, the compositions of the layers were controlled by changing properly the compositions of ZnTe and $In_2Te_3$, the evaporation temperature and the temperature of CdTe. The following Table III shows the characteristics of the elements which were manufactured being heat treated at 550° C for 10 minutes under vacuum or in an inert gas atmosphere after the respective evaporation. A target voltage of 15 volts was applied to the element which was manufactured by flash evaporation. A target voltage of 20 volts was applied to the elements manufactured by both the single and dual evaporation methods.

Table III

| Composition | Evaporation methods / Characteristics | Flash Evaporation Dark Current (A/mm²) | Flash Evaporation Lag-Image (%) | Single Source Evaporation Dark Current (A/mm²) | Single Source Evaporation Lag-Image (%) | Dual Source Evaporation Dark Current (A/mm²) | Dual Source Evaporation Lag-Image (%) |
|---|---|---|---|---|---|---|---|
| | z = 0.7 | $18 \times 10^{-11}$ | 17 | $12 \times 10^{-11}$ | 14 | $16 \times 10^{-11}$ | 18 |
| y = 0.1 | z = 0.95 | $10 \times 10^{-11}$ | 15 | $10 \times 10^{-11}$ | 12 | $14 \times 10^{-11}$ | 18 |
| | z = 1.0 | $15 \times 10^{-11}$ | 23 | $17 \times 10^{-11}$ | 21 | $18 \times 10^{-11}$ | 22 |
| | z = 0.7 | $11 \times 10^{-11}$ | 20 | $5 \times 10^{-11}$ | 12 | $10 \times 10^{-11}$ | 13 |
| y = 0.7 | z = 0.95 | $10 \times 10^{-11}$ | 15 | $3 \times 10^{-11}$ | 10 | $10 \times 10^{-11}$ | 14 |
| | z = 1.0 | $13 \times 10^{-11}$ | 24 | $12 \times 10^{-11}$ | 15 | $14 \times 10^{-11}$ | 23 |
| | z = 0.7 | $8 \times 10^{-11}$ | 20 | $5 \times 10^{-11}$ | 18 | $8 \times 10^{-11}$ | 22 |
| y = 0.9 | z = 0.95 | $5 \times 10^{-11}$ | 24 | $3 \times 10^{-11}$ | 20 | $8 \times 10^{-11}$ | 22 |
| | z = 1.0 | $12 \times 10^{-11}$ | 26 | $10 \times 10^{-11}$ | 22 | $13 \times 10^{-11}$ | 25 |

As can clearly be seen from Table III that, the target of the image pickup tube manufactured by the single source evaporation is preferred since, it has the least dark current and lowest amount of lag-image. The spectrum sensitivity characteristic is illustrated in FIG. 3 and the illumination characteristic is illustrated in FIG. 4. It can be said that the target manufactured by the single source evaporation showed the most desirable characteristics.

The inventors have also examined the variation of the characteristics of the image pickup tube target caused by the change of the coefficients of linear expansion of the light transmitting substrate. When a light transmitting substrate having the same coefficient of linear expansion as that of the conventional substrate used in the $Sb_2S_3$ target and the PbO target, which is 36–50 × $10^{-7}$/° C as averaged between 30° and 300° C, is used as a light transmitting substrate for the target of the image pickup tube, it was found by observation of with a light transmitting microscope that there existed cracks in the second film layer. Then, other targets for the image pickup tube were prepared under exactly the same condition as the above single source evaporation process but using light transmitting substrates having different coefficients of linear expansion. These targets were applied to a one-inch image pickup tube to examine the changes in the characteristics. Table IV shows the results. A target voltage of 20 volts was used.

Table IV

| Characteristics / Coefficient of linear expansion of light transmitting substrate (per 1°C) | Light Sensitivity (μA/1m) | Dark Current (nA) | Resolution Power (number of TV) |
|---|---|---|---|
| Hard Glass $36 \times 10^{-7}$ | 2200 | 45 | 600 |
| Hard Glass $50 \times 10^{-7}$ | 2300 | 41 | 650 |
| Hard Glass $56 \times 10^{-7}$ | 3000 | 10 | 700 |
| Special Glass $63 \times 10^{-7}$ | 3800 | 5 | 700 |
| Special Glass $72 \times 10^{-7}$ | 3920 | 4 | 750 |
| Special Glass $85 \times 10^{-7}$ | 3840 | 4 | 750 |
| Special Glass $95 \times 10^{-7}$ | 3420 | 5 | 700 |
| Special Glass $110 \times 10^{-7}$ | 3000 | 10 | 700 |
| Soda Glass $120 \times 10^{-7}$ | 2500 | 40 | 650 |

It is seen from Table IV that a substantial difference in the characteristics occurs by the change of the coefficient of linear expansion of the light transmitting substrate. Practically, the coefficient of the light transmitting substrate of $56 \times 10^{-7}$/° C–110 × $10^{-7}$/° C is preferable. The variety of characteristics is considered to be responsible for a strain caused by the difference of the coefficient of expansion between the light transmitting substrate and the second layer of the heterojunction element. The coefficients of expansion of the transparent conductive film and the first layer have little influence because they are thin.

Therefore, the composition of the first layer may be $0 \leqq x \leqq 1$ and $0 \leqq u \leqq 1$. If the coefficient of linear expansion of the second layer is different from that of the light transmitting substrate, it is considered that cracks may be produced in the second layer due to a strain caused by the difference between the coefficients of linear expansion of the two layers. The formation of cracks was studied by use of a light transmitting substrate having a linear expansion coefficient of 56 × $10^{-7}$/° C to 110 × $10^{-7}$/° C whereon the first layer having various compositions chosen from $0 \leqq x \leqq 1$ and $0 \leqq u \leqq 1$ and the second layer having various compositions chosen from $0.1 \leqq y \leqq 0.9$ and $0.7 \leqq z \leqq 1$ were deposited. No cracks were observed on the film deposited on the light transmitting substrate having a coefficient of linear expansion of 56 × $10^{-7}$/° C to 110 × $10^{-7}$/° C. Furthermore, the light transmitting substrate having a coefficient of linear expansion of 56 × $10^{-7}$/° C–110 × $10^{-7}$/° C exhibits excellent dark current properties compared with that of other light transmitting substrates.

The inventors of the present invention have also investigated the variation of the characteristics of the target of the image pickup tube due to the change of the substrate temperature and the evaporation temperature. In general, when the target of the image pickup tube is manufactured by an evaporation process, the substrate temperature and the evaporation temperature affect the composition of the film, crystallization thereof, junction interface condition and the degree of damage. The first layer of $ZnS_xSe_{1-x}$ or $Zn_uCd_{1-u}S$ is evaporated by the single source evaporation process with a solid solution being used as an evaporation source or alternatively it may be evaporated by the dual source evaporation process wherein two evaporation sources of ZnS and ZnSe or ZnS and CdS are used to effect simultaneous evaporation. In the latter case, the composition can be varied by controlling the temperatures of the evaporation sources. Of course, the composition depends upon the substrate temperature to some extent. The substrate temperature is normally in the range of 100° – 300° C in either of the processes. Lower substrate temperature results in deterioration of crystallization and an electron beam refraction image approximating that of non-crystalline material is observed. Also, the film is susceptible to being detached from the substrate. Higher substrate temperature, on the other hand, results in lower evaporation rate and hence lower efficiency. The evaporation source temperature can be determined by the evaporation method used, the composition and the density of defect points in the film observed by an optical microscope as black spots in the order of 2–10 $\mu$, which defect points appear as white spots when assembled in the image pickup tube.

The second film of $(Zn_yCd_{1-y}Te)_z\ (In_2Te_3)_{1-z}$ is preferably formed, as described above, by the single source evaporation process, and the substrate temperature and the evaporation source temperature affect the characteristics more closely than in the case where the first film is manufactured. The tables V and VI show the characteristics of the hetero-junction elements as applied to a 1-inch image pickup tube, which elements were manufactured at different substrate temperatures and the evaporation source temperatures and then heat treated at 550° C for 10 minutes under vacuum. Table V corresponds to the hetero-junction element of $ZnS_{0.1}Se_{0.9}$ and $(Zn_{0.7}Cd_{0.3}Te)_{0.95}\ (In_2Te_3)_{0.05}$ wherein the first layer of $ZnS_{0.1}Se_{0.9}$ was formed by using solid solution as an evaporation source. Table VI corresponds to the hetero-junction of $Zn_{0.9}Cd_{0.1}S$ and $(Zn_{0.7}Cd_{0.3}Te)_{0.95}\ (In_2Te_3)_{0.05}$ wherein the first layer of $Zn_{0.9}\ Cd_{0.1}\ S$ was evaporated simultaneously from the evaporation sources of ZnS and CdS. The composition was derived from the optical absorption edge wave length of the film, $\lambda = 360$ m$\mu$.

Table V

| | | | | | | |
|---|---|---|---|---|---|---|
| First Layer | Substrate Temp. (°C) | 100–300 | 100–300 | 100–300 | 100–300 | |
| | Evaporation Source temp. (°C) | 900 | 900 | 900 | 900 | |
| Second Layer | Substrate Temp. (°C) | 80 | 150 | 150 | 250 | Conventional $Sb_2S_3$ Vidicon |
| | Evaporation Source Temp. (°C) | 800 | 800 | 650 | 900 | |
| Target Voltage (V) | | 20 | 20 | 20 | 20 | 35 |
| Sensitivity ($\mu$A/lm) | | 2500 | 3900 | 1800 | 3000 | 310 |
| Dark Current (nA) | | 20 | 4.2 | 23 | 7.0 | 20 |
| Lag-Image (%) | | 20 | 14 | 25 | 25 | 25 |
| Resolution Power (Number of TV) | | 730 | 750 | 700 | 700 | 750 |
| After-Image, Residual Image | | No | No | Yes | Yes | Yes |
| Defect points | | Yes | No | Yes | No | No |

Table VI

| | | | | | | | | |
|---|---|---|---|---|---|---|---|---|
| First Layer | Substrate Temp. (°C) | 100–300 | 100–300 | 100–300 | 100–300 | 100–300 | 100–300 | 100–300 |
| | Evaporation Source Temp. (°C) ZnS (°C) CdS (°C) | 940 740 | 940 740 | 940 740 | 940 740 | 940 740 | 940 740 | 940 740 |
| Second Layer | Substrate Temp. (°C) | 80 | 100 | 280 | 150 | 250 | 150 | 150 |
| | Evaporation Source Temp. (°C) | 800 | 800 | 800 | 650 | 700 | 900 | 950 |
| Target Voltage (V) | | 20 | 20 | 20 | 20 | 20 | 20 | 20 |
| Sensitivity ($\mu$A/lm) | | 2800 | 3700 | 3500 | 1800 | 3600 | 3800 | 3900 |
| Dark Current (nA) | | 25 | 15 | 20 | 25 | 10 | 8 | 24 |
| Lag-Image (%) | | 20 | 14 | 28 | 26 | 25 | 15 | 20 |
| Resolution Power (Number of TV) | | 730 | 750 | 730 | 720 | 750 | 750 | 730 |
| After-Image, Residual Image | | No | No | Yes | Yes | A little | No | No |
| Defect Points | | Yes | No | No | Yes | No | No | Yes |

Tables V and VI show the characteristics of the hetero-junction element of the specific compositions. It is seen from the Tables V and VI that the influence of the substrate temperature and the evaporation source temperature of the second layer on the characteristics tends to remain considerably unchanged regardless of the change of the composition of the first layer. The following Tables VII and VIII show the characteristics of the hetero-junction elements as applied to a 1-inch image pickup tube, which elements were manufactured at different substrate temperatures and evaporation source temperatures and then heat treated at 550° C for 10 minutes under vacuum or in an inert gas atmosphere. The composition of the first layer was chosen to be $0 \leqq x \leqq 1$ and $0 \leqq u \leqq 1$, and the composition of the second layer was chosen to be $0.1 \leqq y \leqq 0.9$ and $0.7 \leqq z \leqq 1$, in that in Table VII, the composition of the second layer was $y = 0.1$ and $z = 1$ (i.e., $Zn_{0.1}Cd_{0.9}Te$) and in Table VIII, the composition of the second layer was $y = 0.9$ and $z = 0.7$ [i.e., $(Zn_{0.9}Cd_{0.1}Te)_{0.7}\ (In_2Te_3)_{0.3}$].

Table VII

| | | | | | | | | |
|---|---|---|---|---|---|---|---|---|
| | $(Zn_{0.1}Cd_{0.9}Te)$ | | | | | | | |
| Substrate Temp. (°C) | 80 | 100 | 100 | 250 | 250 | 280 | 150 | 150 |
| Evaporation | | | | | | | | |

Table VII-continued

| Second Layer Source Temp. (°C) | 700 | 700 | 900 | 700 | 900 | 900 | 650 | 950 |
|---|---|---|---|---|---|---|---|---|
| Target Voltage (V) | 20 | 20 | 20 | 20 | 20 | 20 | 20 | 20 |
| Sensitivity (μA/lm) | 500 | 500 | 550 | 600 | 600 | 600 | 550 | 550 |
| Dark Current (nA) | 28 | 18 | 19 | 18 | 19 | 25 | 28 | 19 |
| Lag-Image (%) | 22 | 21 | 19 | 20 | 20 | 25 | 20 | 19 |
| Resolution Power (Number of TV) | 700 | 720 | 720 | 720 | 720 | 700 | 700 | 720 |
| After-Image, Residual Image | No | No | No | No | No | Yes | No | No |
| Defect Points | Yes | No | No | No | No | No | No | Yes |

Table VIII

| | | $[(Zn_{0.9}Cd_{0.1}Te)_{0.7}(In_2Te_3)_{0.3}]$ | | | | | | |
|---|---|---|---|---|---|---|---|---|
| Substrate Temp. (°C) | 80 | 100 | 100 | 250 | 250 | 280 | 150 | 150 |
| Second Layer Evaporation Source Temp. (°C) | 700 | 700 | 900 | 700 | 900 | 900 | 650 | 950 |
| Target Voltage (V) | 20 | 20 | 20 | 20 | 20 | 20 | 20 | 20 |
| Sensitivity (μA/lm) | 1800 | 2300 | 2600 | 2500 | 2800 | 3000 | 2000 | 2800 |
| Dark Current (nA) | 22 | 15 | 15 | 18 | 15 | 20 | 22 | 20 |
| Lag-Image (%) | 23 | 17 | 17 | 17 | 18 | 25 | 22 | 17 |
| Resolution Power (Number of TV) | 710 | 730 | 730 | 720 | 730 | 720 | 710 | 720 |
| After-Image, Residual Image | No | No | No | No | No | Yes | No | No |
| Defect Points | Yes | No | No | No | No | No | No | Yes |

It is seen from Tables V, VI, VII and VIII that the influence of the substrate temperature and the evaporation source temperature of the second layer on the characteristics tends to remain substantially unchanged regardless of the change of the first film layer and the characteristics are in good conformity with those of the sandwich type cell. As the substrate temperature is increased, the residual image tends to be produced more often and the dark current increases somewhat. When the substrate temperature drops below 100° C, the dark current materially increases, the photoelectric sensitivity decreases and nonuniformity in the characteristic becomes substantial; above 250° C, the photoelectric sensitivity is fairly high but after-image and residual image characteristics deteriorate. The most preferable range for the substrate temperature, therefore, lies between 100° and 250° C. As for the evaporation source temperature, the defect points increase as the evaporation source temperature rises while the indium component is hard to evaporate and the dark current increases as the source temperature decreases. The most preferable range for the evaporation source temperature lies between 700° and 900° C.

The inventors of the present invention further studied the variation of the characteristics of the target of the image pickup tube caused by the heat treatment of the substrate after the first and second layers have been formed on the light transmitting substrate. The target for the image pickup tube using the hetero-junction of $ZnS_xSe_{1-x}$ or $Zn_uCd_{1-u}S$ and $(Zn_yCd_{1-y}Te)_z$ $(In_2Te_3)_{1-z}$ has its characteristics substantially affected by the boundary condition of the hetero-junction and the distribution of the composition of the second layer of $(Zn_yCd_{1-y}Te)_z$ $(In_2Te_3)_{1-z}$ in the direction of the film thickness. By heat treating in an inert gas atmosphere or under vacuum after the formation of the hetero-junction, the characteristics can be considerably improved. Examples thereof are given below.

Figure 5:
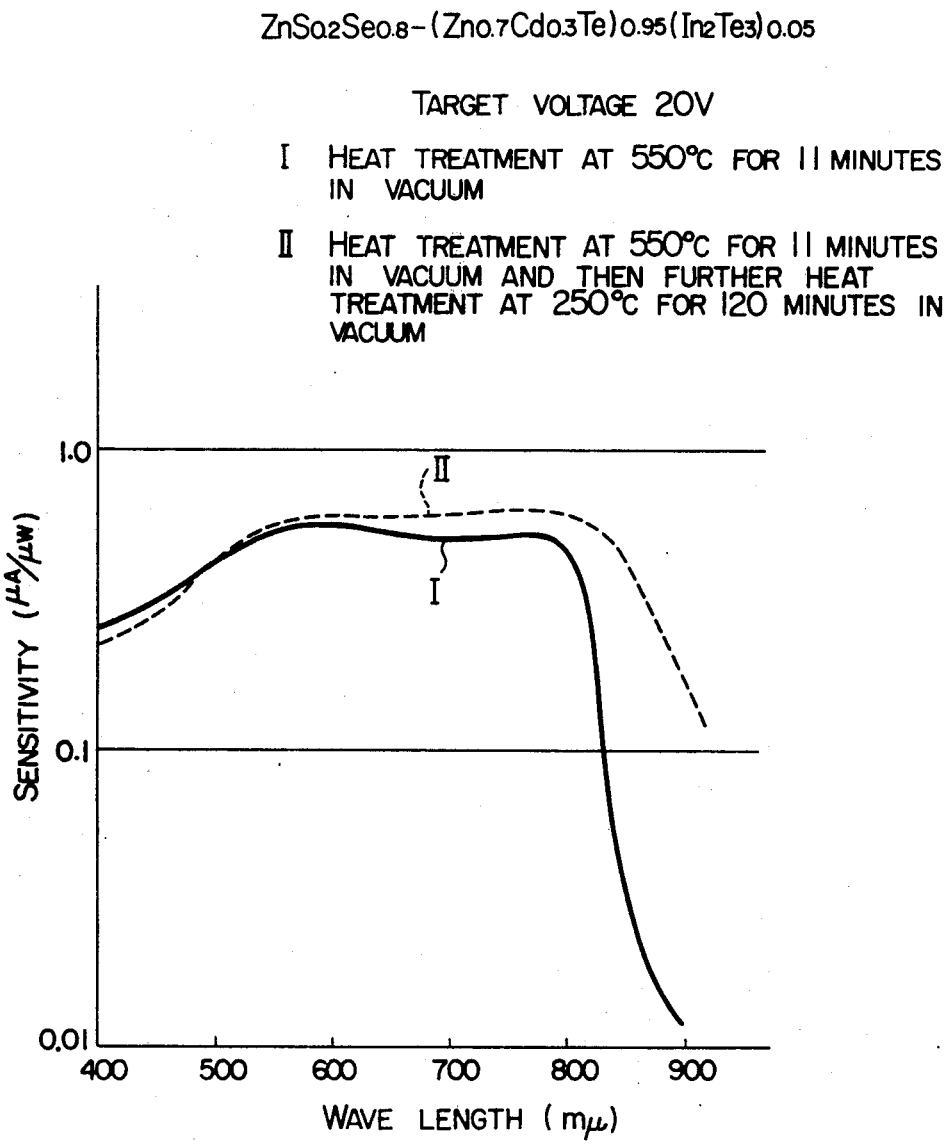
FIG. 5 shows spectrum sensitivity characteristic curves for the hetero-junction of $ZnS_{0.2}Se_{0.8}$ and $(Zn_{0.7}Cd_{0.3}Te)_{0.95}$ $(In_2Te_3)_{0.05}$ manufactured by the single source evaporation process wherein curve I represents the characteristic obtained when heat treated at 550° C for 11 minutes under vacuum and curve II represents the characteristics obtained when heat treated at 550° C for 11 minutes and subsequently again heat treated at 250° C for 120 minutes.

A solid solution of $ZnS_{0.2}Se_{0.8}$ was used as the first layer material and evaporated onto the substrate to the thickness of 0.05 –0.5 μ at the evaporation source temperature of 940° C. As the second layer $(Zn_{0.7}Cd_{0.3}Te)_{0.95}$ $(In_2Te_3)_{0.05}$ was evaporated onto the substrate to the thickness of 3 –10 μ at the evaporation source temperature of 800° C. The film thickness was controlled by the quantities of the evaporation sources and the evaporation time period. The characteristics under such a condition were measured resulting in a dark current of $10^{-4}$ –$10^{-6}$ A/mm² at the applied voltage of several volts, and a sensitivity in the order of $10^{-3}$ –$10^{-6}$ A/mm² at 2000 luxes. Also, a slight amount of spectrum sensitivity was observed in the wave length range of 450 –500 mμ. It is considered that this is because most of the applied voltage appears across the first layer of its neighborhood. Then, the target of the image pickup tube consisting of the hetero-junction as formed in the manner described above was heat treated at 300°–700° C for 3 minutes to 2 hours in an inert gas atmosphere, such as nitrogen gas or argon gas, or under vacuum. As a result, the remarkable improvements of the element such as reduction of the dark current, increase of the sensitivity and improvement of the response speed were observed. When the heat treatment is carried out in the inert gas atmosphere, it is necessary to fully eliminate oxygen and moisture and exchange gas completely. When the heat treatment is carried out below 350° C, longer treatment time is required and no material improvement of the characteristics is provided except for the sensitivity which is superior to that of the prior art $Sb_2S_3$ vidicon. Above 650° C, since the deposited film is evaporated during the heat treatment, the treatment time period must be short. As a consequence it is difficult to obtain good control of the characteristics. Also the defect points are more likely to be produced. The most preferable heat treatment temperature and time period are 500°–600° C and 5 to 15 minutes, respectively, although they change slightly depending upon the substrate temperature upon evaporation, film thickness, composition, evaporation rate, etc. It has been also found that by heat treating the product again at a temperature lower than the first heat treatment temperature the sensitivity, particularly in the area of long wave length, can be further improved. In this case, the heat treatment above 400° C has no effect except for producing defect points, and below 150° C an appreciable improvement of the characteristics is observed. The most preferable temperature and time period of heat retreatment is 150°–400° C and 20 minutes to 3 hours, respectively. Table IX shows the characteristics of the targets for the image pickup tube when applied to a 1-inch image pickup tube treated under vacuum and under different heat treatment conditions. Evaporation conditions of the hetero-junction element were the same as those described above and the film thickness was 5 $\mu$ for each case. The spectrum sensitivity characteristic is illustrated in FIG. 5.

Tables X and XI show the characteristics of the targets for the image pickup tube when applied to a one-inch image pickup tube treated under vacuum or in an inert gas atmosphere under different heat treatment conditions. The composition of the targets used in Table X was $x = 1, y = 0.1$ and $z = 1$ and those of used Table XI was $u = 0, y = 0.9$ and $z = 0.7$.

Table X

| | | | | | | | | | | |
|---|---|---|---|---|---|---|---|---|---|---|
| Heat Treatment | Temp. (°C) | 300 | 350 | 550 | 650 | 700 | 550 | 550 | 550 | 550 |
| | Time (min) | 120 | 90 | 11 | 5 | 3 | 11 | 11 | 11 | 11 |
| Heat Retreatment | Temp. (°C) | — | — | — | — | — | 100 | 150 | 400 | 450 |
| | Time (min) | — | — | — | — | — | 240 | 180 | 20 | 10 |
| Sensitivity ($\mu$A/lm) | | 500 | 600 | 600 | 610 | 620 | 600 | 700 | 700 | 600 |
| Dark Current (nA) | | 30 | 19 | 18 | 19 | 30 | 18 | 19 | 19 | 20 |
| Lag-Image (%) | | 28 | 19 | 20 | 19 | 30 | 20 | 20 | 20 | 28 |
| Resolution Power (Number of TV) | | 700 | 720 | 720 | 720 | 700 | 720 | 720 | 720 | 700 |
| After-Image, Residual Image | | Yes | No | No | No | No | No | No | No | No |
| Defect Points | | Yes | No | No | No | Yes | No | No | No | Yes |

Table XI

| | | | | | | | | | | |
|---|---|---|---|---|---|---|---|---|---|---|
| Heat Treatment | Temp. (°C) | 300 | 350 | 550 | 650 | 700 | 550 | 550 | 550 | 550 |
| | Time (min) | 120 | 90 | 11 | 5 | 3 | 11 | 11 | 11 | 11 |
| Heat Retreatment | Temp. (°C) | — | — | — | — | — | 100 | 150 | 400 | 450 |
| | Time (min) | — | — | — | — | — | 240 | 180 | 20 | 10 |
| Sensitivity ($\mu$A/lm) | | 1600 | 2600 | 2600 | 2800 | 2800 | 2600 | 3000 | 3000 | 2600 |
| Dark Current (nA) | | 25 | 16 | 15 | 15 | 20 | 15 | 16 | 16 | 20 |
| Lag-Image (%) | | 30 | 18 | 17 | 17 | 28 | 17 | 18 | 18 | 25 |
| Resolution Power (Number of TV) | | 700 | 720 | 730 | 730 | 700 | 730 | 730 | 730 | 700 |
| After-Image, Residual Image | | Yes | No | No | No | No. | No | No | No | No. |
| Defect Points | | Yes | No | No | No | Yes | No | No | No | Yes |

Table IX

| | | | | | | | | | |
|---|---|---|---|---|---|---|---|---|---|
| Heat Treatment | Temp. (°C) | 350 | 500 | 550 | 650 | 550 | 550 | 550 | 550 |
| | Time (min) | 90 | 15 | 11 | 5 | 11 | 11 | 11 | 11 |
| Heat Retreatment | Temp. (°C) | — | — | — | — | 150 | 250 | 300 | 400 |
| | Time (min) | — | — | — | — | 180 | 120 | 60 | 20 |
| Sensitivity ($\mu$A/lm) | | 2000 | 3800 | 4000 | 4000 | 4200 | 5000 | 4800 | 4200 |
| Dark Current (nA) | | 20 | 10 | 4.5 | 8.0 | 5.0 | 5.0 | 7.0 | 10.0 |
| Lag-Image (%) | | 25 | 18 | 14 | 16 | 15 | 16 | 17 | 18 |
| Resolution Power (number of TV) | | 700 | 750 | 750 | 750 | 750 | 750 | 750 | 750 |
| After-Image, Residual Image | | Yes | No | No | No | No | No | No | No |
| Defect Points | | No | No | No | A little | No | No | No | A little |
| Spectrum Sensitivity | | — | — | Fig. 5 Curve I | — | — | Fig. 5 Curve II | — | — |

When the composition of the first layer was chosen to be $0 \leqq x \leqq 1$ and $0 \leqq u \leqq 1$, appreciable improvements of the characteristics of the target can be obtained similar to the characteristics obtained in the case of the composition was $x = 0.2$. Furthermore, when the composition of the second layer was chosen to be $0.1 \leqq y \leqq 0.9$ and $0.7 \leqq z \leqq 1$, appreciable improvements of the characteristics of the target can also be obtained similar to the characteristics obtained in the case of the composition was $y = 0.7$ and $z = 0.95$. The

What is claimed is:

1. A method for manufacturing a target for an image pickup tube comprising the steps of:

depositing by evaporation a first layer consisting of $ZnS_xSe_{1-x}$ or $Zn_uCd_{1-u}S$, wherein $0 \leqq x \leqq 1$ and $0 \leqq u \leqq 1$, on a light transmitting substrate having a transparent conductive film thereon, the coeffficient of linear expansion of said light transmitting substrate being within the range $56 \times 10^{-7}/°$ C to $110 \times 10^{-7}/°$ C, depositing by evaporation a second layer consisting of $(Zn_yCd_{1-y}Te)_z(In_2Te_3)_{1-z}$, wherein $0.1 \leqq y \leqq 0.9$ and $0.7 \leqq z \leqq 1$ on said first layer, and heat treating said light transmitting substrate formed with said first and second layers in an inert gas atmosphere or under vacuum at 350°–650° C.

2. A method for manufacturing a target for an image pickup tube as defined in claim 1, wherein the heat treatment temperature for said light transmitting substrate in said inert gas atmosphere or under vacuum is selected within a range of 500°–600° C, and the heat treatment time period is selected within a range of 5–15 minutes.

3. A method for manufacturing a target for an image pickup tube as defined in claim 1, wherein the deposition of said second layer is carried out by heating a single evaporation source while heating said light transmitting substrate.

4. A method for manufacturing a target for an image pickup tube as defined in claim 3, wherein the deposition of said second layer is carried out by heating said evaporation source at a temperature between 700° and 900° C while heating said light transmitting substrate at a temperature between 100° and 250° C.

5. A method for manufacturing a target for an image pickup tube comprising the steps of:

depositing by evaporation a first layer consisting of $ZnS_xSe_{1-x}$ or $Zn_uCd_{1-u}S$, wherein $0 \leqq x \leqq 1$ and $0 \leqq u \leqq 1$, on a light transmitting substrate having a transparent conductive film thereon, depositing by evaporation a second layer consisting of $(Zn_yCd_{1-y}Te)_z(In_2Te_3)_{1-z}$, wherein $0.1 \leqq y \leqq 0.9$ and $0.7 \leqq z \leqq 1$, on said first layer, initially heat treating said light transmitting substrate formed with said first and second layers in an inert gas atmosphere or under vacuum at 350°–650° C, and secondly heat treating said light transmitting substrate at a temperature between 150° and 400° C which is lower than that of the initial heat treatment for a period within a range of 20 minutes to 3 hours.

6. A method for manufacturing a target for an image pickup tube as defined in claim 5, wherein the coefficient of linear expansion of said light transmitting substrate is selected within a range of $56 \times 10^{-7}/°$ C–$110 \times 10^{-7}/°$ C.

* * * * *